United States Patent [19]

Fujisawa

[11] Patent Number: 4,544,921

[45] Date of Patent: Oct. 1, 1985

[54] FIRE ALARM SYSTEM

[75] Inventor: Takao Fujisawa, Omiya, Japan

[73] Assignee: Nittan Company, Limited, Tokyo, Japan

[21] Appl. No.: 421,911

[22] Filed: Sep. 23, 1982

[30] Foreign Application Priority Data

Oct. 9, 1981 [JP] Japan ..... 56-160281

[51] Int. Cl.[4] ..... G08B 21/00

[52] U.S. Cl. ..... 340/584

[58] Field of Search ..... 340/584, 870.11, 870.17, 340/870.38

[56] References Cited

U.S. PATENT DOCUMENTS 4,161,727 7/1979 Thilo et al. ..... 340/584 X 4,369,435 1/1983 Adachi et al. ..... 340/584 X

*Primary Examiner*—Jerry W. Myracle

*Attorney, Agent, or Firm*—Abelman, Frayne, Rezac & Schwab

[57] ABSTRACT

In the fire alarm system comprising a pair of alarm lines, a plurality of fire detectors connected between said alarm lines and a receiving unit connected at the proximal end of the alarm lines, and generating a fire alarm in response to an alarm signal raised by one or more fire detectors, an improved system in which disconnection of alarm lines and number of fire detectors producing alarm signals can be indicated, is disclosed.

6 Claims, 2 Drawing Figures

FIRE ALARM SYSTEM

TECHNICAL FIELD OF THE INVENTION

This invention relates to a fire alarm system.

BACKGROUND OF THE INVENTION

Heretofore, fire alarm systems have generally been constructed to have a plurality of fire detectors connected in parallel between a pair of alarm lines and a receiving unit connected at the proximal end of the alarm lines receives an alarm signal, when any one or more of the fire detectors produce it, by short-circuiting of the pair of alarming lines. Therefore, conventional fire alarm systems are not able to determine at the receiving unit side, whether only one fire detector has produced an alarm signal or two or more fire detectors have produced alarm signals. Furthermore, conventional fire alarm systems often fail to detect fires because of breaking or disconnection of the alarm lines.

Accordingly, the object of this invention is to provide a fire alarm system which can detect any breaking on disconnection of the alarm lines and can determine the number of fire detectors that have produced alarm signals by monitoring the voltage drop across a resistor connected at the send-out position of the alarming lines to overcome the defects of the prior art systems.

DISCLOSURE OF THE INVENTION

This invention provides a fire alarm system comprising a pair of alarm lines, a plurality of fire detectors connected between said alarm lines at the distal end thereof and a receiving unit connected at the proximal end of the alarm lines, and generating a fire alarm in response to an alarm signal produced by one or more fire detectors, wherein the alarm circuit of the detectors includes a serial resistor or a constant current circuit; the receiving unit is provided with a parallel circuit consisting of a resistor for generating a voltage drop and a switching means, said circuit being serially inserted between an electric source and one of the alarm lines; an oscillator circuit for intermittently turning the switching means 'on' and 'off'; and at least one circuit for comparing the electric potential at the junction of the voltage-dropping resistor and the alarm line with a predetermined voltage; and thus disconnection of an alarm line, the number of fire detectors which have produced alarm signals, etc. can be determined by monitoring the electric potential at the alarm line when the switching means is in 'off'-state.

BRIEF DESCRIPTION OF THE DRAWINGS

This invention will now be described in detail with reference to the accompanying drawings, in which.

DETAILED DESCRIPTION OF THE INVENTION

Figure 1:
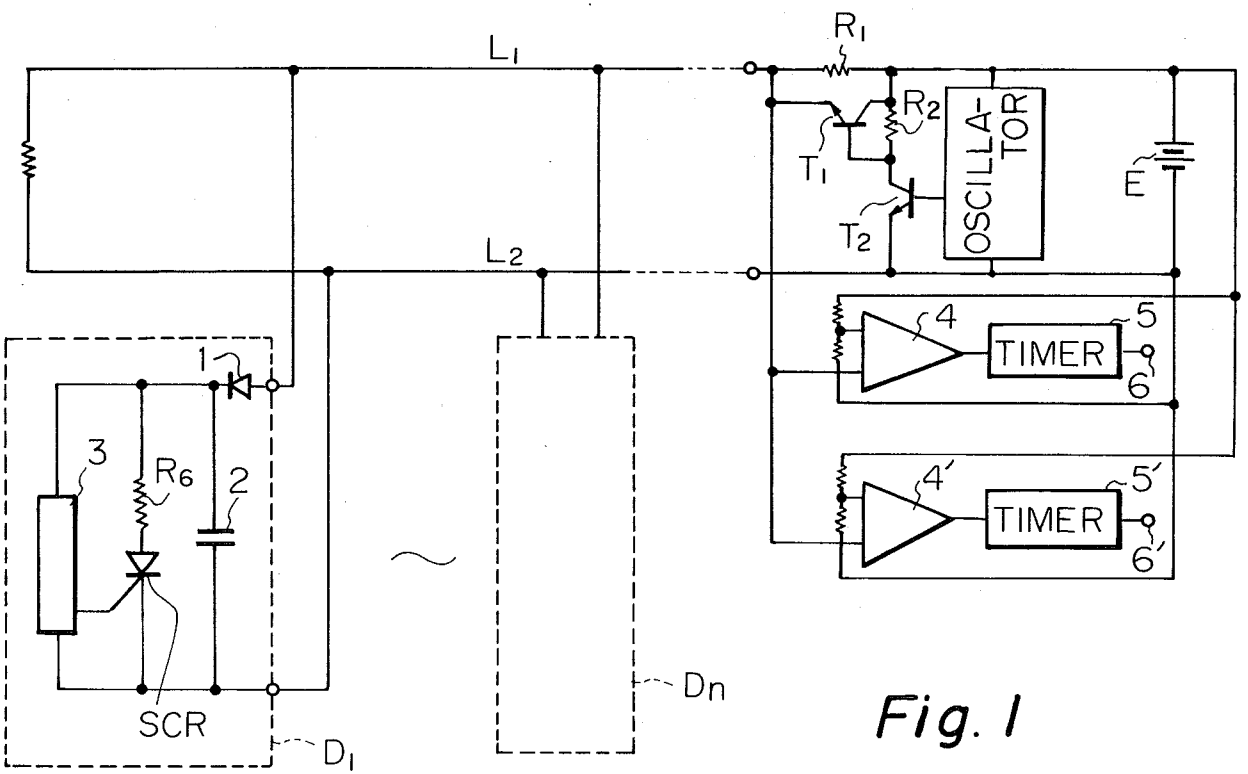
FIG. 1 is a circuit diagram, partially in block form, showing an embodiment of this invention.

In FIG. 1, a plurality of fire detectors $D_1$ to $D_n$ are connected between a pair of alarm lines $L_1$ and $L_2$ and a receiving unit is connected to the proximal end of the alarm lines. A resistor $R_1$ for generating a voltage drop and the collector-emitter circuit of a transistor $T_1$ are connected to form a parallel circuit, which parallel circuit is connected between the positive terminal of an electric source E and the alarm line $L_1$. More particularly, the base of the transistor $T_1$ is connected to the collector of a transistor $T_2$ and one end of a resistor $R_2$, and the other end of the resistor $R_2$ is connected to the positive terminal of the electric source E and the collector of the transistor $T_1$. The emitter of the transistor $T_1$ is connected to the alarm line $L_1$. The emitter of the transistor $T_2$ is connected to the alarm line $L_2$ and the base of the transistor $T_2$ is connected to an oscillator circuit. Any kind of oscillator circuit can be used here. In this preferred embodiment, the oscillator circuit is a well-known combination of resistor, condenser and programmable unijunction transistor (PUT). The negative terminal of the electric source E is directly connected to the alarm line $L_2$.

The junction between the resistor $R_1$ and the alarm line $L_1$ is connected to one input terminal of each of comparators 4 and 4' and the other input terminal of each of the comparators 4 and 4' is biased by bias resistors connected between the positive terminal of the electric source E and the negative terminal thereof. The output terminal of each of the comparators 4 and 4' is connected to a display lamp 6 and 6' respectively through a timer 5 and 5'. The negative terminal of the electric source E is connected to the other input terminal of each of the comparators 4 and 4' through a resistor respectively. In other words, a voltage determined by the two resistors connected across the positive terminal and the negative terminal of the electric source E is applied to the other input terminal of each of the comparators 4 and 4'.

The positive potential of the electric source E is sent forth to the alarm line $L_1$ through the parallel circuit formed by the resistor $R_1$ and the transistor $T_1$ to supply a voltage for operating the fire detectors $D_1$ to $D_n$. As this positive potential is also applied to the base electrode of the transistor $T_1$ through the resistor $R_2$, the transistor is normally in the 'on' state and, therefore, a voltage Vl existing across the alarm lines $L_1$ and $L_2$ is nearly equal to the voltage of the electric source E.

The oscillator circuit intermittently applies pulses to the base electrode of the transistor $T_2$ so that the transistor $T_1$ is turned alternately 'on' and 'off' according to the oscillation period of the oscillator circuit. During the 'off' state of the transistor $T_1$, the current for operating the fire detectors is supplied through the resistor $R_1$ and a voltage drop occurs across the resistor $R_1$. The degree of voltage drop across the resistor $R_1$ is different according to the magnitude of the current sent forth to the alarm line and, therefore, the condition of the detectors (e.g. whether disconnected or short-circuited) can be determined by monitoring the voltage at the ends of the alarm lines $L_1$ and $L_2$.

Each of the fire detectors $D_1$ to $D_n$ comprises a diode 1 and a condenser 2 connected in series across the alarm lines $L_1$ and $L_2$, a fire (heat and/or smoke) sensor 3 also connected in series across the alarm lines and a resistor $R_6$ and a thyristor SCR also connected in series across the alarm lines. The gate of the thyristor SCR is connected to fire sensor 3.

The fire detector operates at the voltage to which the condenser 2 has been charged by the alarm line $L_1$ through diode 1, and consumes a fixed operation current during normal operation. The thyristor SCR turns 'on' when the voltage rise caused by the fire sensor 3 exceeds a fixed value. A current determined by the resistor $R_6$ flows through the thyristor SCR when the thyristor turns 'on' An alarm signal is, therefore, produced when the fire sensor 3 senses occurrence of a fire and generates a voltage exceeding the fixed value. A constant current circuit may be used in place of the resistor $R_6$.

The caused voltage drop across the resistor $R_1$ differs depending upon whether the fire detectors are in the normal condition, only one fire detector has produced an alarm signal, or two or more fire detectors has produced alarm signals. The number of fire detectors that have produced alarm signals can, therefore, be determined by monitoring the electric potential at the junction between the resistor $R_1$ and the alarm line $L_1$ by means of comparators 4, 4', etc. The voltage drops generated across the resistor $R_1$ do not appear continuously but are obtained intermittently only during the periods when the transistor $T_1$ is in the 'off' state and, therefore, it may be arranged so that one output from the comparator can light display lamps 6, 6', etc. for a fixed time by means of timer 5, 5', etc.

If the timings of the timers 5, 5', etc. are selected so that the next voltage drop occurs within the operation period of the timers, the timers may continuously produce outputs and, therefore, the number of the fire detectors that have produced alarm signals can effectively be indicated by the lit state of the display lamps. More particularly, the system may be constructed, for instance, so that the display lamp 6 is lit when only one fire detector produces an alarm signal and the display lamp 6' is lit when two fire detectors produce alarm signals.

Further, no current for operating any fire detector is supplied, nor voltage drop is produced when the alarm line $L_1$ or $L_2$ is disconnected. If an additional comparator, not shown in the drawing, is provided to sense disconnection, the comparator can operate to light an appropriate lamp or to produce an alarm signal of breaking or disconnection, as in a manner similar to that explained above. Further, if many comparators are provided, the system can determine how many of a larger number of the fire detectors are producing alarm signals.

Figure 2:
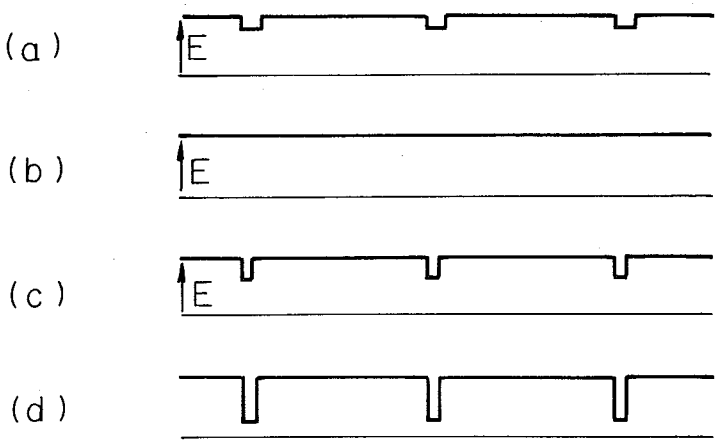
FIG. 2 shows waveforms of the voltage at the end of the alarm lines in the embodiment given in FIG. 1, in which (a) denotes the waveform in the normal state, (b) denotes the waveform when the alarm lines are disconnected, (c) denotes the waveform when an alarm signal is produced by only one fire detector, and (d) denotes the waveform when alarm signals are produced by two fire detectors.

In FIG. 2, the waveforms show the voltage at the send-out position of the alarm line $L_1$. As can be seen from these waveforms, the voltage of the alarm line merely drops intermittently for a short time when one or two detectors produce alarm signals. Accordingly, the current for operating the fire detectors can be supplied from the voltage charged on the condenser 2 provided in each detector. In other words, all the other detectors can stably continue normal operation.

A constant current circuit may be used in place of the resistor $R_6$ in FIG. 1. In such case, the current flowing through the resistor $R_1$ is made exactly proportional to the number of the fire detectors that have produced alarm signals. Accordingly, the number can be easily determined and, consequently, the number of fire detectors to be connected can be increased.

Sensitive smoke or heat sensors often produce false fire alarms upon sensing smoke or temperature rise not caused by a fire. In the fire alarm system, however, if two or more fire sensors are provided in each area under observation, and the system is designed so that an alarm is generated only when two or more sensors have sensed smoke, heat, etc., generation of false alarms by sensitive fire sensors can be prevented. This is one of the practical uses of this fire alarm system.

Needless to say, the intermittent oscillator circuit comprising a PUT in the above embodiment may be replaced with an ordinary pulse oscillator circuit. Further, the timer 5 may, of course, be a monostable multivibrator.

As described above, the fire alarm system of this invention is constructed so that a resistor for generating a voltage drop is serially inserted in the alarm line and the load condition is monitored by sensing the voltage drop across the resistor generated by the actuation of a fire detector. Thus, the number of the fire detectors that have produced alarm signals can be determined and the disconnection of the alarm lines can be detected by monitoring the load condition. In addition, the fire detectors operate stably, since the above-mentioned voltage drops across the resistor is merely intermittent and the current for the fire detectors is supplied from the voltage charged on the condenser built in each fire detector during the voltage drop periods.

INDUSTRIAL APPLICABILITY OF THE INVENTION

As has been explained above, this invention provides a fire alarm system more reliable than the conventional ones.

I claim:

1. A fire alarm system comprising:

(a) a pair of alarm lines having a proximal end and a distal end;

(b) a plurality of fire detectors connected between said alarm adjacent said distal end, each of the fire detectors producing an alarm signal and including a series resistor;

(c) a receiving unit connected between said lines adjacent said proximal end and generating a fire alarm in response to an alarm signal, the receiving unit including a parallel circuit which includes a voltage-dropping resistor and a switching means, said parallel circuit being in series between a voltage source and one of the alarm lines;

(d) an oscillator circuit for turning the switching means on and off; and (e) at least one circuit for comparing the voltage at the junction of the voltage-dropping line and the alarm line with a predetermined voltage, whereby on disconnection of an alarm line, the number of fire detectors which may have produced alarm signals, and like information can be determined by monitoring the voltage at said junction when the switching means is turned off.

2. A fire alarm system comprising:

(a) a pair of alarm lines having a proximal end and a distal end;

(b) a plurality of fire detectors connected between said alarm adjacent said distal end, each of the fire detectors producing an alarm signal and including a constant current source;

(c) a receiving unit connected between said lines adjacent said proximal end and generating a fire alarm in response to an alarm signal, the receiving unit including a parallel circuit which includes a voltage-dropping resistor and a switching means, said parallel circuit being in series between a voltage source and one of the alarm lines;

(d) an oscillator circuit for turning the switching means on and off; and (e) at least one circuit for comparing the voltage at the junction of the voltage-dropping line and the alarm line with a predetermined voltage, whereby on disconnection of an alarm line, the number of fire detectors which have produced alarm signals, and like information can be determined by monitoring the voltage at said junction when the switching means is turned off.

3. A fire alarm system as recited in claims 1 or 2, wherein the oscillator circuit comprises a programmable unijunction transistor.

4. A fire alarm system as recited in claims 1 or 2, which is provided with two or more circuits for comparing the electric potential at the junction of the voltage-dropping resistor and the alarm line with a predetermined value.

5. A fire alarm system as recited in claims 1 or 2, wherein the comparing circuit is provided with a timer.

6. A fire alarm system as recited in claim 5, wherein the timer is a multivibrator circuit.

* * * * *